US008517091B2

(12) United States Patent
Bahorich et al.

(10) Patent No.: US 8,517,091 B2
(45) Date of Patent: Aug. 27, 2013

(54) METHOD FOR INCREASING FLUID RECOVERY FROM MULTIPLE LATERAL WELLBORES DRILLED THROUGH A SUBSURFACE FORMATION

(75) Inventors: Michael S. Bahorich, Houston, TX (US); Mark E. Bahorich, Houston, TX (US); Benjamin L. Bahorich, Houston, TX (US); Eric J. Bahorich, Houston, TX (US)

(73) Assignee: Apache Corporation, Houston, TX (US)

( * ) Notice: Subject to any disclaimer, the term of this patent is extended or adjusted under 35 U.S.C. 154(b) by 292 days.

(21) Appl. No.: 13/021,980

(22) Filed: Feb. 7, 2011

(65) Prior Publication Data

US 2011/0192591 A1 Aug. 11, 2011

Related U.S. Application Data

(60) Provisional application No. 61/302,202, filed on Feb. 8, 2010.

(51) Int. Cl.
*E21B 43/30* (2006.01)

(52) U.S. Cl.
USPC ..... 166/245; 166/50; 166/52

(58) Field of Classification Search
USPC ..... 166/245, 50, 52
See application file for complete search history.

(56) References Cited

U.S. PATENT DOCUMENTS 4,676,313 A * 6/1987 Rinaldi ..... 166/252.1
2009/0090499 A1* 4/2009 Lewis et al. ..... 166/52

* cited by examiner

*Primary Examiner* — Kenneth L Thompson
*Assistant Examiner* — Taras P Bemko
(74) *Attorney, Agent, or Firm* — Richard A. Fagin

(57) ABSTRACT

A method for creating a drainage network in a subsurface rock formation includes drilling a first plurality of wellbores extending laterally in a first direction. Each wellbore includes a main portion and an extension portion extending therefrom. A second plurality of wellbores is drilled laterally in a second direction substantially opposed to the first direction. Each of the second plurality of wellbores includes a main portion and an extension portion extending therefrom. The extension portions of the first plurality of wellbores are disposed adjacent main portions of the second plurality of wellbores. The extension portions of the second plurality of wellbores are disposed adjacent main portions of the first plurality of wellbores. Each main portion is hydraulically isolated from each associated extension portion. Each main portion of each of the first and second plurality of wellbores is stimulated.

5 Claims, 1 Drawing Sheet

Step 3

New method of pad drilling using pad tubes current method for pad drilling

Step 1 extended drilling method

Step 2

Step 3

Step 4

METHOD FOR INCREASING FLUID RECOVERY FROM MULTIPLE LATERAL WELLBORES DRILLED THROUGH A SUBSURFACE FORMATION

CROSS-REFERENCE TO RELATED APPLICATIONS

Priority is claimed from U.S. Provisional Application No. 61/302,202 filed on Feb. 8, 2010.

STATEMENT REGARDING FEDERALLY SPONSORED RESEARCH OR DEVELOPMENT

Not applicable.

BACKGROUND OF THE INVENTION

1. Field of the Invention

The invention relates generally to the field of drilling multiple lateral wellbores to produce fluids from a subsurface rock formation. More particularly, the invention relates to techniques for drilling and fracturing multiple lateral wellbores to increase fluid recovery from the rock formation.

2. Background Art

Certain types of subsurface rock formations are hydraulically connected to the Earth's surface for production therefrom of oil and/or gas. In such formations, a drainage network of lateral wellbores is drilled generally along the bedding planes of the formations. The relatively large drainage area created by such wellbore networks may enable rock formations having relatively low permeability to produce commercially valuable quantities of oil and/or gas.

An example drainage network is shown in FIG. 1. To minimize damage to the surface, a number of wellbores may be drilled from relatively small area surface locations prepared for operation of a drilling unit (not show). Such locations are shown schematically at 12 and 14 and are typically referred to as "pads." A plurality of laterally extending wellbores 10 is drilled, initially vertically, and then along selected trajectories laterally along a selected ("target") formation, shown generally at 15. Typically the lateral wellbores 10 will be laterally spaced apart from each other in a selected geometric arrangement within the target formation 15. A typical arrangement of lateral wellbores is shown in FIG. 1 in which the lateral wellbores 10 drilled from a first pad 12 extend generally in parallel toward the end of lateral wellbores 10 drilled from an adjacent second pad 14. However, the lateral displacement of the lateral wellbores 10 is typically limited so that wellbores from adjacent pads generally do not extend past each other (i.e., traverse the same area of the target formation 15) as shown in FIG. 1.

There continues to be a need to improve fluid recovery from subsurface rock formations using networks of lateral wellbores.

SUMMARY OF THE INVENTION

A method according to one aspect of the invention for creating a drainage network in a subsurface rock formation includes drilling a first plurality of wellbores extending laterally in a first direction. Each wellbore includes a main portion and an extension portion extending therefrom. A second plurality of wellbores is drilled laterally in a second direction substantially opposed to the first direction. Each of the second plurality of wellbores includes a main portion and an extension portion extending therefrom. The extension portions of the first plurality of wellbores are disposed adjacent main portions of the second plurality of wellbores. The extension portions of the second plurality of wellbores are disposed adjacent main portions of the first plurality of wellbores. Each main portion is hydraulically isolated from each associated extension portion. Each main portion of each of the first and second plurality of wellbores is stimulated.

Other aspects and advantages of the invention will be apparent from the following description and the appended claims.

DETAILED DESCRIPTION

Figure 2:
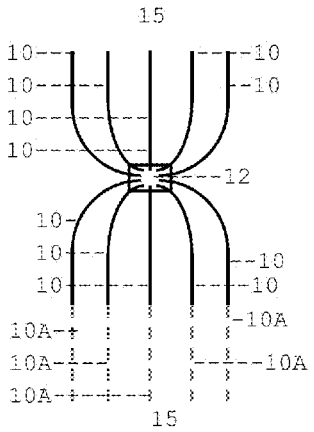
FIG. 2 shows drilling extensions from lateral wellbores from a first pad.

Referring to FIG. 2, a plurality of main lateral wellbores 10 may be drilled from a first pad 12 in a selected pattern through a target subsurface rock formation 15, as explained in the Background section herein. The main lateral wellbores 10 extend generally in a direction toward corresponding main wellbores drilled from an adjacent second pad (14 in FIG. 3). The main lateral wellbores 10 may be drilled from a single "pilot" wellbore (not shown separately) that is drilled substantially vertically from the first pad 12. Alternatively, the main lateral wellbores 10 may be drilled from the first pad 12 separately. Non-limiting example procedures and devices for drilling multiple lateral wellbores from a single pilot wellbore are described in U.S. Pat. No. 5,785,133 issued to Murray et al. and in U.S. Pat. No. 5,735,350 issued to Longbottom et al., both of which are incorporated herein by reference.

Figure 1:
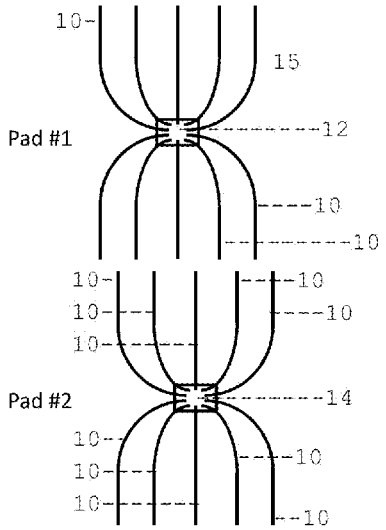
PRIOR ART FIG. 1
FIG. 1 shows a prior art pad drilling arrangement for drilling a network of lateral wellbores into a subsurface rock formation.

In an example of the present method, the main wellbores 10 are drilled to a much greater lateral distance from the first pad 12 toward the adjacent second pad 14 in what may be called "extension" wellbores 10A. As explained in the Background section with reference to FIG. 1, main wellbores 10 may be drilled toward each other from adjacent pads, e.g., first and second pads 12, 14, but such main wellbores 10 do not extend laterally from the respective pads 12, 14 to an extent that main wellbores 10 from adjacent pads 12, 14 traverse the same portion or area of the target formation 15. In a method according to the invention, the extension wellbores 10A extend longitudinally from the respective first and second pads 12, 14 so that the extension wellbores 10A from one pad (e.g., first pad 12) penetrate the same (area) portion of the target formation 15 as the main wellbores 10 from the adjacent pad (e.g., second pad 14 in FIG. 1).

Figure 3:
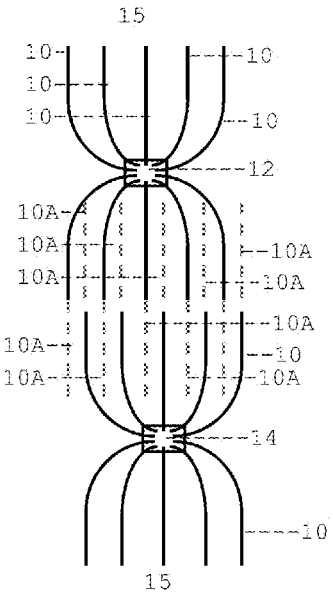
FIG. 3 shows drilling extensions from lateral wellbores from a second, adjacent pad.

As shown in FIG. 3, main lateral wellbores 10 with extension wellbores 10A drilled therefrom may be drilled from the adjacent second pad 14 in a selected pattern toward the wellbores 10, 10A drilled from the first pad 12. The wellbores from each pad 12, 14 are laterally offset from each other so that the extension wellbores 10A from one pad are disposed adjacent to the main wellbores 10 from the adjacent pad. Some of the extension wellbores 10A from the first pad 12 may be disposed laterally between two main wellbores 10 from the second pad 14, and vice versa.

Each of the main wellbores 10 may be completed, such as by cementing casing therein and perforating the casing, or inserting slotted liner therein. Subsequently the main wellbores 10 are stimulated, for example, by hydraulic fracture treating, explained further below. The extension wellbores 10A may left as open hole, and not fracture treated or otherwise stimulated. To keep the extension wellbores 10A from collapsing, it may be preferable to fill the extension wellbores 10A with slotted casing or a slotted liner. It may also be desirable to fill the extension wellbores 10A with gravel or sand to prevent collapse.

Figure 4:
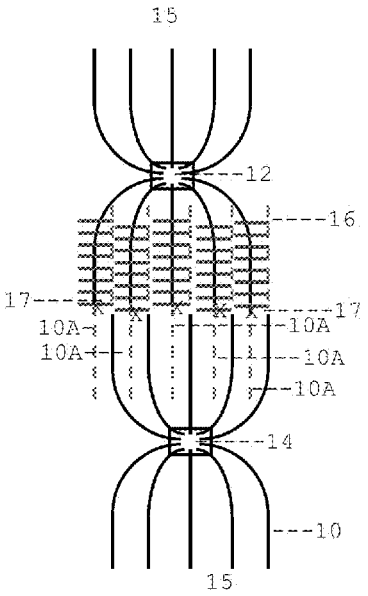
FIG. 4 shows fracture treating the main part of wellbores drilled from the first pad.

As shown in FIG. 4, stimulation treatment, such as hydraulic fracturing, may be performed through the main wellbores 10 extending from the first pad 12. In order to stimulate each main wellbore 10, it may be useful to put a plug 17 at the terminal end of each main wellbore 10 to hydraulically isolate the main wellbore 10 from the associated extension wellbore 10A. In the present example, a fracture network 16 is created by fracture treating each main wellbore 10. The fracture network 16 may extend from the main wellbores 10 from the first pad 12, through the adjacent extension wellbores 10A from the second pad 14.

Figure 5:
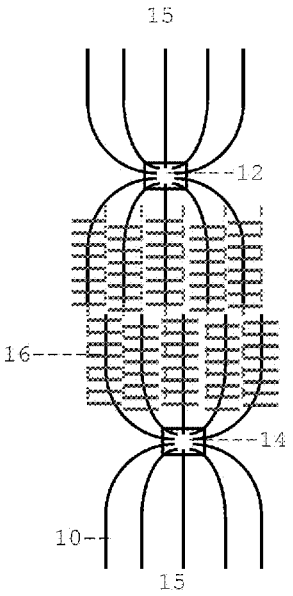
FIG. 5 shows fracture treating the main part of the wellbores drilled from the second pad.

In FIG. 5, the stimulation(e.g., hydraulic fracturing) may be performed on the main wellbores 10 extending from the second pad 14, for example, creating a fracture network 16. The fracture network 16 extending from the main wellbores 10 from the second pad 14 may be expected to extend through the extension wellbores 10A from the first pad 12. The overall arrangement of main and extension wellbores 10, 10A, respectively, and fracture networks 16 may be expected to increase overall fluid recovery from the target formation 15 as contrasted with the wellbore network shown in FIG. 1.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for creating a drainage network in a subsurface rock formation, comprising drilling a first plurality of wellbores extending laterally in a first direction, each wellbore including a single main portion extending from a vertical portion of a first single wellbore and terminating at a single extension portion extending therefrom;

drilling a second plurality of wellbores extending laterally in a second direction substantially opposed to the first direction, each of the second plurality of wellbores including a single main portion extending from a vertical portion of a second single wellbore spaced apart from the first single wellbore and terminating at an extension portion extending therefrom, the extension portions of the first plurality of lateral wellbores disposed laterally adjacent to main portions of the second plurality of lateral wellbores, the extension portions of the second plurality of lateral wellbores disposed laterally adjacent to main portions of the first plurality of lateral wellbores;

hydraulically isolating each main portion from each associated extension portion using a single hydraulic isolation device; and stimulating each main portion of each of the first and second plurality of wellbores.

2. The method of claim 1 wherein the stimulating comprises hydraulic fracturing.

3. The method of claim 1 further comprising inserting a slotted liner inside each extension portion.

4. The method of claim 1 further comprising filling each extension portion with at least one of sand and gravel.

5. The method of claim 1 wherein each plurality of wellbores is drilled from an associated pad at the Earth's surface.

* * * * *